US005501550A

United States Patent [19]

Calabrese

[11] Patent Number: 5,501,550

[45] Date of Patent: Mar. 26, 1996

[54] PILE ASSEMBLY AND METHOD EMPLOYING EXTERNAL MANDREL

[76] Inventor: Salvatore J. Calabrese, 5917 Oakland Park Dr., Burke, Va. 22015

[21] Appl. No.: 272,561

[22] Filed: Jul. 11, 1994

[51] Int. Cl.[6] ..... E02D 5/34

[52] U.S. Cl. ..... 405/232; 405/239; 405/242

[58] Field of Search ..... 405/240, 241, 405/242, 243, 239, 232, 233, 231, 229, 230; 175/219

[56] References Cited

U.S. PATENT DOCUMENTS

| | | | |
|---|---|---|---|
| 822,588 | 6/1906 | Cummings . | |
| 890,765 | 6/1908 | Gilbreth | 405/242 X |
| 951,668 | 3/1910 | Welsh . | |
| 1,645,398 | 10/1927 | Pierce . | |
| 1,742,926 | 1/1930 | Newton . | |
| 1,775,217 | 9/1930 | Thornley . | |
| 1,954,188 | 4/1934 | Thornley | 405/243 |
| 2,326,155 | 8/1943 | McCook | 405/243 |
| 2,554,896 | 5/1951 | Caudill . | |
| 3,034,304 | 5/1962 | Upson . | |
| 3,187,513 | 6/1965 | Guild . | |
| 3,198,857 | 8/1965 | Childers et al. . | |
| 3,206,935 | 9/1965 | Phares . | |
| 3,512,365 | 5/1970 | Muller | 405/243 X |
| 3,902,326 | 9/1975 | Langenbach | 405/229 X |
| 3,925,998 | 12/1975 | LeCorgne . | |
| 4,618,289 | 10/1986 | Federer . | |
| 4,971,479 | 11/1990 | Byers, Sr. et al. . | |
| 4,992,002 | 2/1991 | DeWitt . | |
| 5,020,605 | 6/1991 | Lieshman . | |

OTHER PUBLICATIONS

"An Interpile Licensee Can Furnish and Install All Types Of Foundation Anywhere Including The Patented INTER-PILE", Interpile USA, Inc., 888 Brickell Avenue, Suite 610, Miami, FL 33131, 1976.

"Big-based pile does its own soil compaction", Construction Methods & Equipment, Apr. 1973; Copyright 1973 by McGraw-Hill Inc.

FRANKI, Franki Foundation Co., 920 Statler Office Bldg., Boston, MA 02116.

"HEL-COR Pile Shell", CONTECH Construction Products, Inc., Jul., 1988.

"The TPT Pile, A New Concept in Piling", UnderPinning & Foundation Constructors, Inc., Engineers and Contractors, a division of Alpha Portland Industries, Inc. (API), 48th Street, Maspeth, NY 11378, Sep. 1976 [& Mar. 1977].

"TPT JOBSHEET", Apr. 1975, No. 1, Underpinning & Foundation Constructors, Inc., A Division of Alph Portland Industries.

*Primary Examiner*—Dennis L. Taylor
*Attorney, Agent, or Firm*—Larson and Taylor

[57] ABSTRACT

A piling assembly is provided which comprises a casing unit comprising an upright hollow casing having a drive boot secured to the bottom of the casing, and an external mandrel adapted to be supported on the drive boot in surrounding relation with the casing. The mandrel includes a lateral opening therein which enables the mandrel to be placed around the casing through relative lateral movement. A driving force is applied to the mandrel so as to drive the drive boot into the ground such as to create a hole in the ground having walls spaced from the mandrel and casing and the resultant space is filled with grout. The mandrel is then removed and the casing filled with concrete.

10 Claims, 2 Drawing Sheets

PILE ASSEMBLY AND METHOD EMPLOYING EXTERNAL MANDREL

FIELD OF THE INVENTION

The present invention relates to piles and pile assemblies and, more particularly, to an improved pile assembly and piling method that provide important advantages over prior art.

BACKGROUND OF THE INVENTION

Many different types of support piles have been used over the years. Timber was perhaps the first piling material while other materials including steel and concrete were subsequently utilized. Steel piles include HP sections, steel pipe (usually concrete filled) and monotube piles. Concrete piles can be either precast (including both the reinforced and prestressed types) or cast in place. Cast in place concrete piles can further be separated into the non displacement type (auger-cast-pile) or the displacement type. Cast in place concrete displacement piles may be cast directly against the surrounding soil as in the Interpile, Hi-cap, Dewitt, and Atlas piles. Enlarged base piles such as the Franki pile (pressure injected footing) are also cast directly against the surrounding soil. Cast in place concrete displacement piles may also be cast against a metal pipe or metal shell which had previously been [bin] drive in to the ground. Metal shells are driven into the ground with the aid of a mandrel such as the step-tapered mandrel (developed by Raymond) or a uniform cross section mandrel (Guiles Mandrel and others). Another type of enlarged base pile the TPT in one form employs a corrugated steel shell secured to the precast tip and internal steel mandrel adapted to be driven by a hammer ram. Some of these pile types will be discussed in more detail below.

Before further discussing the prior art, it will be understood that for a particular project, the particular site geology and structural loads to be borne are considered in conjunction with the cost and load carrying capacity of each of the various pile types and that this analysis usually results in the use of one or at the most two types of the piles. Thus, a pile that can be used throughout a site having different soil conditions provides an advantage over less versatile piles.

In recent years, the cast in place grout piles and, in particular, the augured cast in place pile, has steadily increased in use in the deep foundation market. The auger cast in place pile system uses an auger that is advanced, i.e., screwed directly into the ground. After the auger is advanced to the required depth grout is pumped through the hollow stem of the auger and out through an opening at the tip of the auger. The auger is then pulled out of the ground while grout is released into the hole created by the retreating auger. The auger is not unscrewed from the hole but rather is pulled out in the manner of cork, and the soil that is engaged by and captured in the flights of the auger is removed. Since the soil is removed from the ground and not displaced laterally as in the case of a drive type pile (steel, precast concrete, mandrel driven shells, enlarged base piles etc.) these augured cast in place piles are considered non displacement piles.

Despite the increasing popularity of the auger cast pile, the technique, and other cast-in-place grout piles in general, suffer important disadvantages. These include the following: (1) the inability to fully inspect the completed pile; (2) difficulties in placing reinforcing steel and, in particular, hooked bars or full length reinforcing cages; (3) the integrity of the pile shaft in a variety of soil conditions may be questioned; and (4) the lack of a dynamic procedure by which production piles can be compared to the test pile.

Considering some of these disadvantages in more detail, it is noted that the sides of the hole created during the piling process can push or press in during the removal of the auger and there is no guarantee that the hole will be cylindrical or even that the grout column will be continuous from tip to ground surface. Once the auger is pulled out there can be no inspection of the proper cross sectional area of the pile because the hole is filled with grout, and because of the unknown shape of the pile and the presence of the ever stiffening grout, insertion of a steel reinforcing cage is a problem. Further, with augured cast in place piles, the auger is screwed into the ground to a predetermined depth and because soil conditions can vary widely across a job site, the selected depth may not be optimum at all locations. With driven piles, a test pile is first driven into the ground and resistance to its penetration into the ground is noted. After a load test is conducted on the test pile a relationship between the load carrying capacity of the pile and the resistance to penetration of the pile into the ground is established using any of a variety of generally accepted dynamic formulas. This relationship thus established is used to regulate the installation of subsequent piles at a particular site. The depth to which each pile is driven varies depending on the soil conditions at the individual pile locations. As noted above, with augured cast in place piles there is no generally accepted analytical procedure by which production piles can be compared to a test pile so as to permit a production pile to be tailored to the soil conditions encountered.

Pile systems using mandrel driven shells use both internal and external mandrels. One basic problem with such systems is that of inserting the mandrel into or around the shell and, in particular, the necessity to raise the mandrel above the shell to enable the mandrel to be inserted therein or therearound. For example, assuming that the shell, and thus the mandrel, are fifty feet (50') in height, the upper end of the mandrel must be raised to a height of one hundred feet (100') in order to permit the mandrel to be inserted into a free standing shell. This problem has been overcome to a large extent through the use of so-called "doodle holes" which enable the shell to be inserted in such a previously created oversized hole to substantial depth so as to greatly reduce the height to which the mandrel must be lifted prior to insertion thereof into the shell. The mandrel and shell are then lifted as a unit out of the "doodle hole" for subsequent use. The Raymond "step-tapered" piling system referred to above provides a stepped and tapered "doodle hole."

SUMMARY OF THE INVENTION

In accordance with the invention, a piling system or assembly is provided which affords important advantages over the augured grout systems and mandrel driven systems described above and which is of a cost that is at least competitive with that of such augured or mandrel driven systems. The piling system of the invention is fully inspectable, presents no problems with respect to reinforcement, can be used in soft or fluid strata and permits establishment of a dynamic correlation between a test pile and production piles.

In accordance with one aspect of the invention, a piling assembly comprises a casing unit comprising an upright hollow casing and a drive boot secured to the bottom of the casing and extending laterally beyond the outer periphery of the casing, and an external mandrel adapted to be supported on said drive boot in surrounding relation with said casing. The mandrel is of a height greater than that of said casing and includes an opening therein along the height thereof of a size greater than the greatest width of the casing so as to enable the mandrel to be placed around the casing through relative lateral movement between the mandrel and casing.

Advantageously, the casing is substantially cylindrical and the mandrel is U-shaped in transverse cross section. The casing advantageously comprises a corrugated shell. Preferably, the drive boot comprises a metal plate. In accordance with a second aspect of the invention, a method is provided producing a pile in the ground, the method comprising: placing a unit, comprising an upright hollow casing and an integral drive plate of a greater base area than the casing, at a location at which a pile is to be provided; moving an external mandrel having an opening in a lateral wall thereof into surrounding relation around the casing and on top of the drive plate; applying a driving force to said mandrel so as to drive the drive plate into the ground such as to create a hole in the ground having walls spaced from said mandrel and said casing and thus to produce a space surrounding said casing with grout; filling the space with grout; removing said mandrel from said hole before the grout sets; and filling the interior of the hollow casing with concrete. The space can be filled with grout as the hole is being created or can be filled with grout after the hole is created.

Preferably, the method further comprises disposing at least one reinforcement member in the interior of said casing for reinforcing the concrete. The casing is advantageously filled with concrete after said reinforcement member is disposed in said casing. The mandrel is preferably U-shaped in transverse cross-section and is moved laterally into the surrounding relation around the casing.

Other features and advantages of the invention will be set forth in, or apparent from, the following detailed description of preferred embodiments of the invention.

DESCRIPTION OF THE PREFERRED EMBODIMENTS

Figure 1:
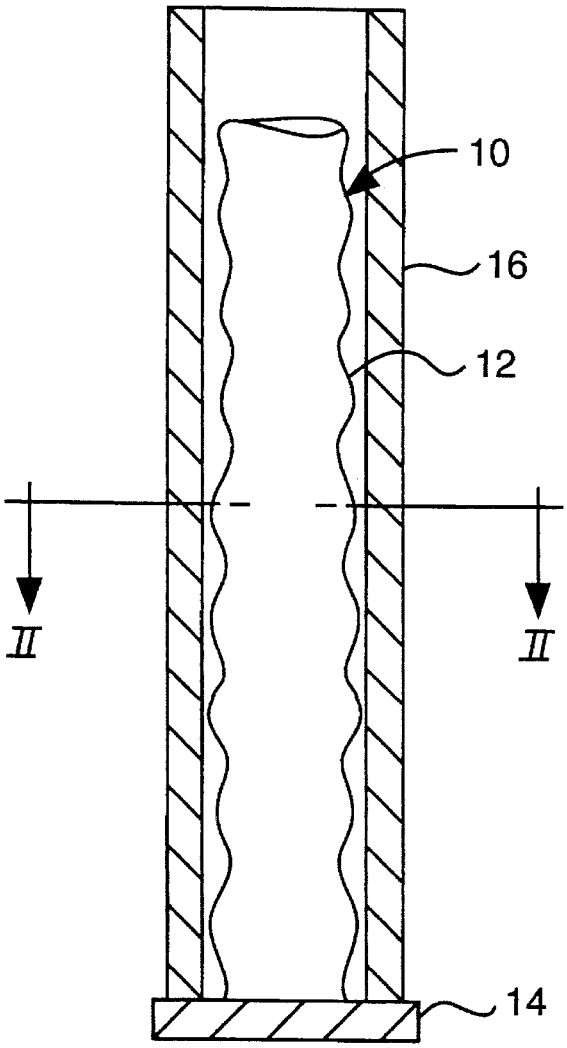
FIG. 1 is a cross sectional view of a pile assembly in accordance with a preferred embodiment of the invention.
Figure 2:
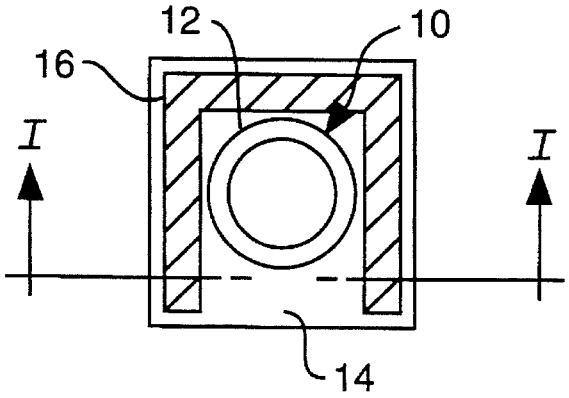
FIG. 2 is a traverse cross section view generally taken along line II—II of FIG. 1.
Figure 3A:
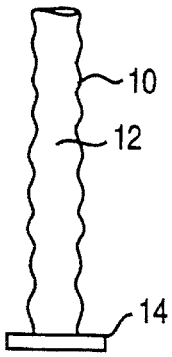
FIGS. 3(*a*) to 3(*f*) illustrate schematically the steps employed in a preferred embodiment of the method of the invention.
Figure 3B:
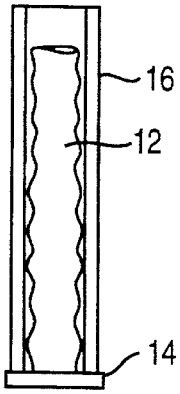
Figure 3C:
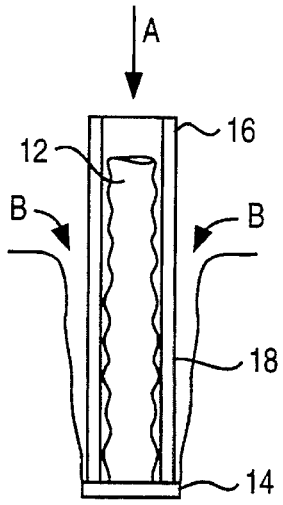
Figure 3D:
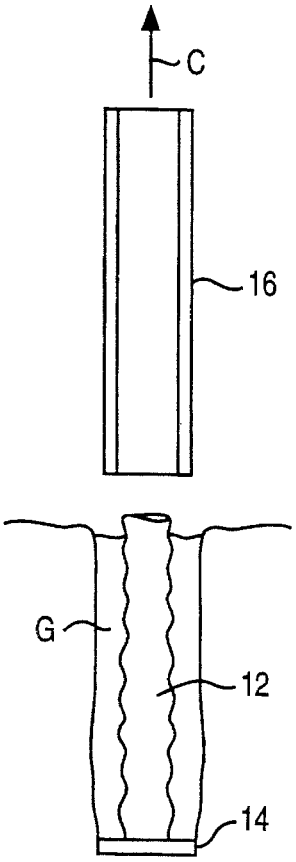
Figure 3E:
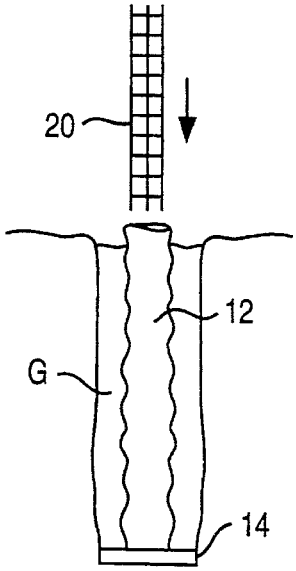
Figure 3F:
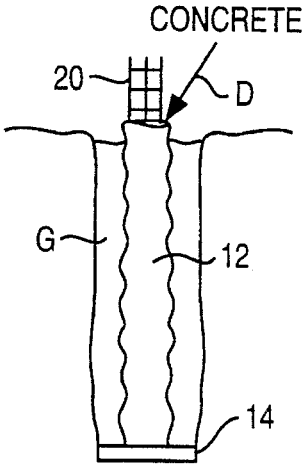

Referring to FIGS. 1 and 2, the basic elements of the piling assembly or system of the present invention are shown. The system comprises two components, a shell unit or element 10 including a thin casing or shell 12 and an integral boot plate or drive boot 14, and a mandrel 16. Shell 12 is corrugated in the exemplary embodiment illustrated in FIGS. 1 and 2 but take different forms (e.g., the shell can have smooth cylindrical walls). Shell 12 can be made of a number of different materials such as sheet metal, plastic and the like since the shell does not have to bear driving forces. In contrast, boot plate 14, which comprises a heavy duty rectangular plate in the illustrated embodiment, should be made of a strong material, such as steel or another strong metal, that can withstand pile driving forces exerted thereon. As illustrated, the base area of drive boot 14 is greater than the cross sectional area of casing or shell 12.

As shown in FIG. 2, mandrel 16 is of a U-shaped cross section which permits mandrel 16 to simply be moved laterally onto boot plate 14 so as to surround shell 12. Other cross sectional shapes can, of course, be used, but one important aspect of the invention concerns the provision in the overall piling assembly of a mandrel which has an open side or other vertical opening along the length (height) thereof so as to enable the mandrel to be simply placed around the casing or shell 12 without the need to lift the mandrel up over the shell and then lower the mandrel down around or into the shell. Mandrel 16 should obviously be made of a strong material, since as would be expected and is explained below, mandrel receives the driving blows used to drive the piling assembly into the ground.

Referring to FIGS. 3(*a*) to 3(*e*), the piling method of the invention is illustrated. Initially, as shown in FIG. 3(*a*), the shell unit 10 is placed at the site at which the piling is to be provided and next, as shown in FIG. 3(*b*), the external mandrel 16 is placed around shell 14 and on top of drive boot 15. The assembly is now ready for driving. It is noted that, alternatively, a combined shell unit and mandrel can be moved to and placed at the pile location.

With the assembly in place, the combination of unit 12 and mandrel 16 is driven into the ground, as illustrated in FIG. 3(*c*), by forces, indicated by arrow A, exerted on the top of mandrel 16, by a drive hammer or other pile driving apparatus, and transmitted to drive boot 14. As shown, the hole produced by drive boot 14 is of a greater area than the diameter of shell 12 so that a space 18 is created around shell 12. This space 18 is filled with grout as indicated by small arrows B as the assembly is being driven into the ground. The grout can either flow into the space by gravity from a reservoir at the ground surface or be pumped into the ground by means of grout tubes located on the mandrel. The grout, which is denoted G in FIG. 3(*d*), fills the space 18 and in its fluid state (before it sets) serves as a medium for stabilizing the hole created by the drive boot and reduces friction on the mandrel from the surrounding soil as the assembly is being driven into the ground. After the grout sets, it serves as a transfer medium for transferring forces from the shell 12 to the walls of the hole and is actually better than dirt or soil for this purpose. The grout need not be of high quality (high strength) since the shell formed by the grout around the casing 12 is not part of the actual pile construction per se. In this regard, it is of note that the shape of the hole is not important, i.e., it is not necessary to provide regular smooth sided walls, and, in fact, irregular walls can be of an advantage in providing good engagement between the grout G and the surrounding soil. The grout also serves as a lubricating medium and, referring to FIG. 3(*d*), makes it easier to remove mandrel 16 through the exerting of a lifting or pulling force thereon as indicated by arrow C. Removal of mandrel 16 is the next step after the drive boot 14 has been driven to the appropriate depth and the space 18 around casing 12 has been filled with grout G.

It will be appreciated that up to this point, the interior or casing or shell 12 has not been filled and, at this point or any point prior to filling the shell 12 with concrete, the shell 12 can be inspected visually throughout its interior to determine that the correct cross-sectional shape has been maintained. Also prior to filling the shell 12 with concrete, a reinforcement such as the reinforcement cage 20 shown in FIG. 3(*e*) can be readily positioned within the interior of casing 14. The piling is then competed, as shown in FIG. 3(*f*) by filling the casing 14 with concrete, as is indicated by arrow D.

It is noted that although in the preferred embodiment the mandrel 16 is open along the entire length thereof, some of the advantages of the invention could be achieved by providing a mandrel wherein an opening is provided at the bottom that extends over less than the full length. This embodiment would require some lifting but the height to which the mandrel would be lifted would be reduced.

Although the present invention has been described relative to specific exemplary embodiments thereof, it will be understood by those skilled in the art that variations and modifications can be effected in these exemplary embodiments without departing from the scope and spirit of the invention.

What is claimed is:

1. A piling assembly comprising a casing unit comprising an upright hollow casing having a bottom and an outer periphery and a drive boot secured to the bottom of the casing and extending laterally beyond the outer periphery of the casing; and an external mandrel adapted to be supported on said drive boot in surrounding relation with said casing, said mandrel being of a height greater than that of said casing and having an opening therein along the height thereof of a size greater than the greatest width of the casing so as to enable the mandrel to be placed around the casing through relative lateral movement between the mandrel and casing.

2. An assembly as claimed in claim 1 wherein said casing is substantially cylindrical and said mandrel is U-shaped in transverse cross section.

3. An assembly as claimed in claim 2, wherein said casing comprises a corrugated shell.

4. As assembly as claimed in claim 1 wherein said drive boot comprises a metal plate.

5. A method producing a pile in the ground, said method comprising:

placing a unit, comprising an upright hollow casing and an integral drive plate of a greater base area than said casing, at a location at which a pile is to be provided;

moving an external mandrel having an opening in an lateral wall thereof into surrounding relation around the casing and on top of the drive plate;

applying a driving force to said mandrel so as to drive the drive plate into the ground such as to create a hole in the ground having walls spaced from said mandrel and said casing and thus to produce a space surrounding said casing;

filling said space with grout;

removing said mandrel from said hole before the grout sets; and filling the interior of the hollow casing with concrete.

6. A method as claimed in claim 5 wherein said space is filled with grout as said hole is being created.

7. A method as claimed in claim 5 wherein said space is filled with grout after said hole is created.

8. A method as claimed in claim 5 further comprising disposing at least one reinforcement member in the interior of said casing for reinforcing said concrete.

9. A method as claimed in claim 8 wherein said casing is filled with concrete after said reinforcement member is disposed in said casing.

10. A method as claimed in claim 5 wherein said mandrel is U-shaped in transverse cross-section and is moved laterally into a surrounding relation around said casing.

* * * * *